US005985438A

United States Patent [19]

Watanabe

[11] Patent Number: 5,985,438

[45] Date of Patent: Nov. 16, 1999

[54] REINFORCING TAPE FOR SLIDE FASTENER

[75] Inventor: Kozo Watanabe, Kurobe, Japan

[73] Assignee: YKK Corporation, Tokyo, Japan

[21] Appl. No.: 09/035,968

[22] Filed: Mar. 6, 1998

[30] Foreign Application Priority Data

Mar. 7, 1997 [JP] Japan ..... 9-068974

[51] Int. Cl.[6] ..... B32B 7/12

[52] U.S. Cl. ..... 428/343; 29/33; 29/33.2; 29/34; 29/408; 29/410; 29/766; 29/769; 425/205; 425/264; 425/500; 428/343; 428/354; 442/149; 442/150; 442/151

[58] Field of Search ..... 29/33.2, 33, 3 U, 29/408, 410, 766, 769 W; 425/205, 264 W, 500; 428/343, 354; 442/149, 150, 151

[56] References Cited

U.S. PATENT DOCUMENTS

| | | | |
|---|---|---|---|
| 3,490,970 | 1/1970 | Heimberger . | |
| 3,503,102 | 3/1970 | Inazawa . | |
| 3,663,996 | 5/1972 | Heimberger et al. . | |
| 3,785,014 | 1/1974 | Canepa | 24/205 |
| 4,566,156 | 1/1986 | Sarasue et al. | 24/398 |
| 4,651,389 | 3/1987 | Yoshida et al. | 24/433 |
| 4,922,584 | 5/1990 | Funakawa et al. | 24/381 |
| 5,231,737 | 8/1993 | Fröhlich et al. . | |
| 5,728,460 | 3/1998 | Hirasawa et al. | 428/349 |

FOREIGN PATENT DOCUMENTS

| | | |
|---|---|---|
| 0 336 347 | 10/1989 | European Pat. Off. . |
| 0 739 597 | 10/1996 | European Pat. Off. . |
| 44-25843 | 10/1969 | Japan . |
| 62-149780 | 7/1987 | Japan . |
| 8-299033 | 11/1996 | Japan . |
| 1 507 915 | 4/1978 | United Kingdom . |

*Primary Examiner*—Jenna Davis
*Assistant Examiner*—Arti R. Singh
*Attorney, Agent, or Firm*—Hill & Simpson

[57] ABSTRACT

A reinforcing tape for a slide fastener and a slide fastener having a pair of fastener tapes whose end portions are reinforced with the reinforcing tapes are disclosed. On the end portion of a fastener tape to which a pin-and-box separator of a slide fastener is fitted, a transparent film layer formed of a thermoplastic elastomer or a thermoplastic resin and a fiber reinforcement layer formed of either a reticular sheet of monofilaments or a thin-layer non-woven fabric of fibers manufactured from a thermoplastic resin of the same type as the transparent film layer are superposed through the medium of an adhesive layer, with the transparent film layer constituting itself a surface layer.

14 Claims, 3 Drawing Sheets

REINFORCING TAPE FOR SLIDE FASTENER

BACKGROUND OF THE INVENTION

1. Field of the Invention

This invention relates to reinforcing structure for the end portions of fastener tapes in a separable slide fastener, and more particularly to a reinforcing tape or reinforcing sheet material to be attached fast to each of the end portions of fastener tapes, especially to the end portions of dyed fastener tapes, adapted for attachment thereto of a pin-and-box separator and a slide fastener provided with fastener tapes having the end portions thereof reinforced therewith.

2. Description of the Prior Art

The conventional reinforcing tapes to be applied fast to the end portions of dyed fastener tapes have included those which, for the sake of obviating the necessity of preparing reinforced tapes dyed specially in various colors matched to the colors of the aforementioned dyed fastener tapes and consequently saving such time and labor as would otherwise be incurred in the inventory control, use transparent synthetic resin films in a superposed manner so as to show the colors of the dyed fastener tapes therethrough. For example, the reinforcing piece which is formed of two superposed transparent synthetic resin films having different melting points and is adapted to be applied fast to a fastener tape by melting that of the two films having a lower melting point as disclosed in Japanese Utility Model Publication No. (hereinafter referred to briefly as "JUM-B-") 44-25,843 and the lateral application tape which is formed by superposing on one side of a transparent film of nylon 6 or nylon 66 a transparent polyester copolymer film having a melting point in the range of 80 to 200° so as to show the color of the base fabric of the fastener tape therethrough as disclosed in published Japanese Patent Application, KOKAI (Early Publication) No. (hereinafter referred to briefly as "JP-A-") 62-149,780 have been known to the art.

Also JP-A-08-299,033 discloses a reinforcing tape which has a transparent elastomer film used for the obverse surface layer and an adhesive layer superposed on the reverse surface thereof and U.S. Pat. No. 3,490,970 discloses a method for reinforcing the end portions of fastener tapes by causing a wire mesh of metal or synthetic resin to adhere to at least one face of each of the fastener tapes by the use of a thermoplastic resin under application of heat and pressure.

Since the reinforcing tapes formed of two layers of synthetic resin film as are disclosed in JUM-B-44-25,843 and JP-A-62-149,780 mentioned above have the component layers thereof invariably formed of film, they are at a disadvantage in being deficient in torsional strength and transverse tensile strength (laterally drawing strength). Since they are hard from the material point of view, they cannot be easily shaped by bending in conformity with the shape of the core portion of the fastener tape and, for this reason, the core portion of the fastener tape is not easily formed accurately in contour thereof. Further, these reinforcing tapes have the problem that when they are repeatedly bent, the bent lines thereof ultimately cause whitening possibly to the extent of jeopardizing the appearance of the reinforcing tapes.

The reinforcing tape disclosed in JP-A-08-299,033 forms the surface layer with an elastomer film and, therefore, is at an advantage in exhibiting due flexibility and consequently allowing itself to be easily bent in conformity with the contour of the core portion of the fastener tape. Since the component layers of this reinforcing tape are formed of film, however, the reinforcing tape has room for further improvement in terms of torsional strength and transverse tensile strength.

The reinforcing tape disclosed in U.S. Pat. No. 3,490,970 which resorts to the combination of a thermoplastic resin with a wire mesh gains in rigidity and secures satisfactory strength owing to the wire mesh. It nevertheless is at a disadvantage in assuming a rigid constituent as a whole, suffering from insufficiency in flexibility, and consequently incurring difficulty in being shaped by the kind of bending which is mentioned above.

SUMMARY OF THE INVENTION

An object of the present invention, therefore, is to provide a reinforcing tape for a slide fastener which excels not only in flexibility but also in such mechanical properties as torsional strength and transverse tensile strength.

A further object of the present invention is to provide a reinforcing tape which possesses due transparency as a whole, allows the color of the dyed fastener tape to be directly seen therethrough, permits itself to be easily shaped in conformity with the contour of the core portion of the fastener tape intended for attachment thereto of a fitting piece, consequently allows the core portion of the fastener tape to be easily formed accurately in contour, and moreover enables itself to be joined with sufficient adhesive strength to the end portion of the fastener tape of the slide fastener.

Another object of the present invention is to provide a slide fastener which comprises a pair of fastener tapes each having an end portion reinforced with the reinforcing tape mentioned above.

To accomplish the objects described above, one aspect of the present invention provides a reinforcing tape for slide fasteners comprising a fiber reinforcement layer formed of either a reticular sheet of thermoplastic resin monofilaments or a thin-layer non-woven fabric of thermoplastic resin fibers (meaning a very thin sheet having component fibers not fixed by adhesion; which definition similarly applies hereinafter) and at least one transparent film layer made of a thermoplastic elastomer or thermoplastic resin and adapted to be superposed on at least one surface of the fiber reinforcement layer, characterized by the fact that the raw material for the fiber reinforcement layer and that for the transparent film layer are thermoplastic resins of the same type or system. The reinforcing tape may further comprises an adhesive layer adapted to be adhered to a fastener tape in such a manner that the transparent film layer constitutes itself a surface layer.

In accordance with another aspect of the present invention, there is provided a slide fastener comprising a pair of fastener tapes each having an end portion reinforced with a reinforcing tape for attachment of a pin-and-box separator, characterized in that the reinforcing tape comprises at least one transparent film layer made of a thermoplastic elastomer or thermoplastic resin and a fiber reinforcement layer formed of a reticular sheet of monofilaments or a thin-layer non-woven fabric of fibers manufactured from a thermoplastic resin of the same type as the transparent film layer and is secured to the end portion of the fastener tape through the medium of an adhesive layer in such a manner that the transparent film layer constitutes itself a surface layer.

In a preferred embodiment of the present invention, a hot-melt adhesive using as the raw material therefor a resin of the same type as the raw material for the fastener tape is adopted for the adhesive layer mentioned above. In a more preferable specific embodiment of the present invention, the fiber reinforcement layer mentioned above is formed of a reticular sheet of monofilaments or a thin-layer non-woven fabric of fibers of a polyester thermoplastic resin and the transparent film layer mentioned above is made of a polyester thermoplastic elastomer. In another preferred specific embodiment of the present invention, the fiber reinforcement layer mentioned above is formed of a reticular sheet of monofilaments or a thin-layer non-woven fabric of fibers of a polyamide thermoplastic resin and the transparent film layer mentioned above is made of a polyamide thermoplastic elastomer or nylon.

BRIEF DESCRIPTION OF THE DRAWINGS

Other objects, features, and advantages of the invention will become apparent from the following description taken together with the drawings, in which.

DETAILED DESCRIPTION OF THE PREFERRED EMBODIMENTS

The reinforcing tape for slide fasteners according to the present invention is enabled by interposing a fiber reinforcement layer formed of a reticular sheet of monofilaments of thermoplastic resin or a thin-layer non-woven fabric of thermoplastic resin fibers between a transparent film layer constituting itself a surface layer and an adhesive layer or an underlying transparent film layer as described above to retain sufficient flexibility and, at the same time, eliminate the vulnerability to twist or lateral drawing which forms a fault inherent in film, and secure high torsional strength and transverse tensile strength. It is enabled to secure high flexibility particularly by using a thermoplastic elastomer as the raw material for the transparent film layer. During the adhesion of the reinforcing tape to the fastener tapes under the application of heat and pressure, since thermoplastic resins of the same type are used as the raw materials for the fiber reinforcement layer and the transparent film layer mentioned above, the layers on being softened (or partially fused) and joined exhibit high adhesive strength. Particularly during the adhesion of the fiber reinforcement layer to the fastener tapes through the medium of the adhesive layer, high interlaminar strength is obtained because the softened and/or fused resin of the adhesive layer infiltrates in the spaces among the lattices of the reticular sheet or the gaps among the individual fibers of the non-woven fabric as the fiber reinforcement layer and joins the transparent film layer as the surface layer. In this case, the material for the adhesive layer may be any of the materials in common use on the sole condition that it exhibit proper affinity for the raw material for the fastener tapes. Preferably, a hot-melt adhesive, particularly a hot-melt adhesive using as the raw material therefor a resin of the same type as the raw material for the fastener tape, is used. As a result, the reinforcing tape can be applied with high adhesive strength to the fastener tapes. Since the component layers of the reinforcing tape mentioned above are transparent or essentially nearly transparent, the color of the dyed fastener tapes can be directly seen through the applied reinforcing tape. The reinforcing tape of one kind can be applied to fastener tapes of varying color tones.

Now, the present invention will be described more specifically below with reference to the accompanying drawings.

Figure 1:
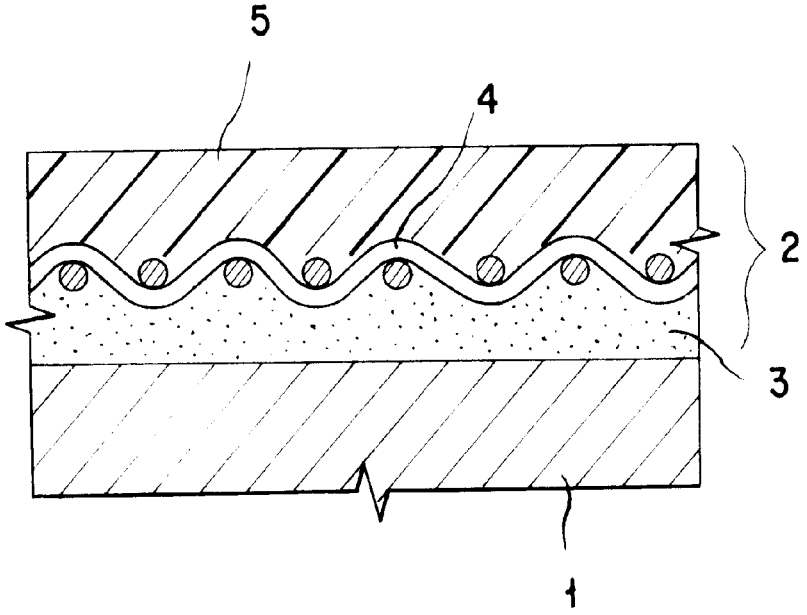
FIG. 1 is a fragmentary cross-sectional view of the end portion of a fastener tape provided with a reinforcing tape of the present invention.

FIG. 1 illustrates one example of the construction of a reinforcing tape 2 secured to the end portion of a fastener tape 1 of a slide fastener according to the present invention. On the fastener tape 1, a fiber reinforcement layer 4 and a transparent film layer 5 are superposed sequentially in the order mentioned through the medium of an adhesive layer 3 to give rise to the reinforcing tape 2.

Figure 2:
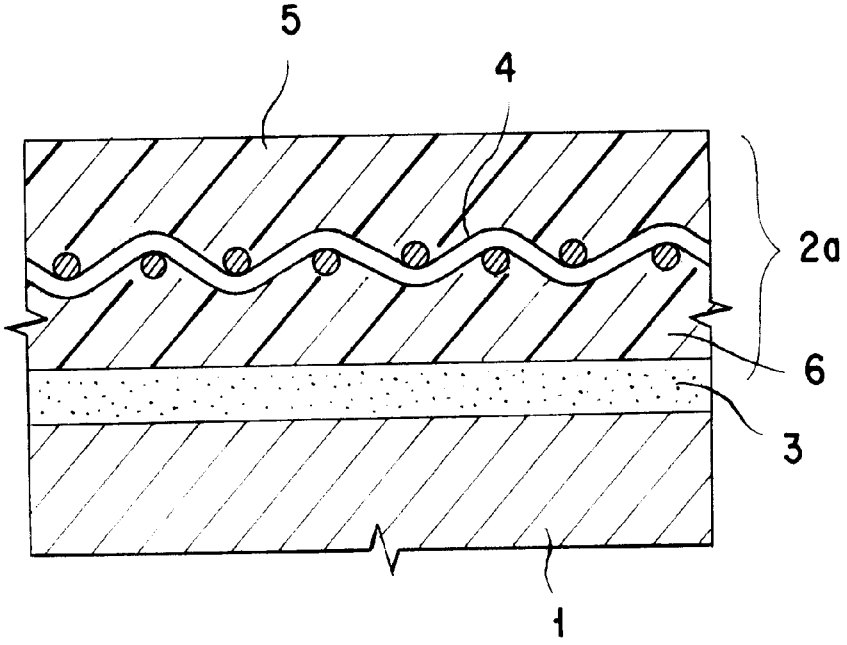
FIG. 2 is a fragmentary cross-sectional view of the end portion of a fastener tape provided with a reinforcing tape as another embodiment of the present invention.

In the example of the construction illustrated in FIG. 2, a lower transparent film layer 6, the fiber reinforcement layer 4, and the transparent film layer 5 as a surface layer are superposed sequentially in the order mentioned on the fastener tape 1 through the medium of the adhesive layer 3 to give rise to a reinforcing tape 2*a*.

FIG. 1 and FIG. 2 depict constructions which have the reinforcing tapes 2 and 2*a* superposed respectively on one surface of the fastener tape 1. Notwithstanding this fact, it goes without saying that the reinforcing tape can be superposed on each of the opposite surfaces of the fastener tape. Generally, this superposition is effected on both the opposite surfaces of the fastener tape 1.

A hot-melt adhesive having proper affinity for the material of the fastener tape 1, particularly a hot-melt adhesive using as the raw material thereof a resin of the same type as the material of the fastener tape 1, is used preferably for the adhesive layer 3. When the material of the fastener tape 1 is polyester fibers, for example, a transparent polyester copolymer obtained by the condensation polymerization of a dial component such as ethylene glycol, propane diol, butane dial, neopentyl glycol, 2,4-dimethyl-2-ethylhexyl-1,3diol, hexane dial, cyclohexane dimethanol, or p-xylene glycol with a dicarboxylic acid component such as terephthalic acid, isophthalic acid, phthalic acid, adipic acid, sebacic acid, dimethyl terephthalic acid, biphenyl dicarboxylic acid, malonic acid, succinic acid, glutaric acid, azelaic acid, or cyclohexane dicarboxylic acid, optionally further with other copolymerizable monomer is advantageously used. When the material of the fastener tape is nylon, a ternary or higher transparent nylon copolymer of a relatively low melting point obtained by the copolymerization of a monomer such as nylon 6, nylon 66, nylon 610, or nylon 612 and having lauryl lactam, ω-12-aminocarboxylic acid or ω11-aminocarboxylic acid as a main component thereof can be favorably used. As a matter of course, the melting point of the hot-melt adhesive must be set at a lower level than the melting points of the fiber reinforcement layer 4 and the transparent film layers 5 and 6.

The thickness of the adhesive layer is appropriate generally in the approximate range of 3–120 μm, preferably 50–70 μm.

As the fiber reinforcement layer 4, a thin-layer non-woven fabric of thermoplastic resin fibers (a very thin sheet having component fibers not fixed by adhesion) can be used besides such a reticular sheet (mesh) formed of monofilaments of thermoplastic resin as illustrated in FIG. 1 and FIG. 2. As concrete examples of the thermoplastic resin to be used herein, polyesters such as polyethylene terephthalate (PET), polybutylene terephthalate (PBT), and PET/PBT polymer alloy, polyamides such as nylon 6 and nylon 66, polyolefins such as polypropylene and polyethylene, and fluorocarbon resins of the polytetrafluoroethylene type may be cited.

When the fiber reinforcement layer is formed of a reticular sheet, the diameter of the monofilaments making up the sheet is proper in the range of 50–120 μm and the density in the longitudinal and the lateral directions is preferable in the approximate range of 20–70 monofilaments/cm respectively. In contrast, when the fiber reinforcement layer is formed of a thin-layer non-woven fabric, the thickness thereof is preferred to be in the approximate range of 50–120 μm. If the diameter of the monofilaments or the thickness of the thin layer non-woven fabric unduly exceeds the upper limit of the range mentioned above, the reinforcing tape has the disadvantage of losing flexibility and tending to decrease transparency in spite of the advantage of gaining in torsional strength and transverse tensile strength. If the diameter or the thickness is smaller than the lower limit of the range mentioned above, the reinforcing tape has the disadvantage of incurring difficulty in securing sufficient torsional strength and transverse tensile strength. The diameter of the monofilaments making up the reticular sheet or the thickness of the thin layer non-woven fabric and the density of the filaments or fibers may be suitably set preferably in the relevant ranges mentioned above in due consideration of the thicknesses of the transparent film layer and the adhesive layer so as to balance such factors as strength, flexibility, and transparency.

Though various thermoplastic elastomers and thermoplastic resins such as polyamides including nylon 6 and nylon 66 and polyesters used generally for the surface layer of the reinforcing tape are usable for the transparent film layers 5 and 6, a thermoplastic elastomer proves to be preferable particularly in terms of flexibility. As the thermoplastic elastomer, the polyester thermoplastic elastomers and the polyamide thermoplastic elastomers which have been well known heretofore are advantageously used. The polyolefin thermoplastic elastomers which use a polyolefin rubber like ethylene-propylene rubber (EPR) or partially cross-linked EPR as a soft segment and a polyolefin resin like polypropylene as a hard segment and the fluorocarbon thermoplastic elastomers which use a fluororubber like a vinylidene fluoride-hexafluoro-propylene copolymer as a soft segment and a fluorocarbon resin like ethylene-tetrafluoroethylene copolymer or polyvinylidene fluoride as a hard segment are likewise usable. Thermoplastic resins of the same type are preferred to be used as the materials of the transparent film layer and the fiber reinforcement layer as described above. When the fiber reinforcement layer is formed of polyester monofilaments or fibers, for example, a polyester thermoplastic elastomer is used for the material of the transparent film layer. When the fiber reinforcement layer is formed of polyamide monofilaments or fibers, a polyamide thermoplastic elastomer or nylon is used. The thickness of the transparent film layer 5 as the surface layer is preferred to be in the approximate range of 50–150 μm and the thickness of the lower transparent film layer 6 in the approximate range of 20–50 μm. If the thicknesses of these transparent film layers are unduly large, the reinforcing tape is at a disadvantage in increasing the thickness and decreasing the flexibility.

In reinforcing the end portion of the fastener tape 1, the transparent film layers 5 and 6 may be superposed on either or both of the opposite surfaces of the fiber reinforcement layer 4 by the conventional method of superposition like the dry laminating method or the co-extrusion method. Alternatively, the reinforcing tapes 2 and 2*a* may be preparatorily manufactured by coating the fiber reinforcement layer 4 (or the lower transparent film layer 6 where the fiber reinforcement layer 4 is provided on the opposite surfaces thereof with the transparent film layers 5 and 6) with the adhesive layer 3 and subsequently adhered to the surfaces of the end portion of the fastener tape 1 under application of heat and pressure through the medium of the adhesive layer 3. Otherwise, the adhesive layer 3 may be applied to the surfaces of the end portion of the fastener tape 1 and then the materials for forming the other layers 4, 5, and 6 mentioned above are superposed thereon in the order illustrated in FIG. 1 and FIG. 2 and subsequently fixed thereon under application of heat and pressure. Any of the heating means such as, for example, a hot plate, ultrasonic wave, and high-frequency wave can be used for the heating during the application of heat and pressure.

In the manner described above, the end portion of the fastener tape 1 is reinforced by the application thereto with high adhesive strength of the reinforcing tape 2 or 2*a* possessing such transparency or translucency as to allow the color of the fastener tape 1 to be seen therethrough, manifesting flexibility, and excelling in torsional strength and transverse tensile strength. Since the reinforcing tape 2 or 2*a* is nearly transparent as a whole, it allows the color of the fastener tape 1 to be directly seen therethrough. Since the reinforcing tape appears in essentially the same color as the dyed fastener tape 1, it will not impair the appearance of the fastener tape 1. For the purpose of allaying the surface gloss of the reinforcing tape or augmenting the flexibility thereof, the transparent film layer 5 as the surface layer may be knurled after or during the application of heat and pressure.

Now, embodiments of the present invention will be described below with reference to the accompanying drawings.

Figure 3:
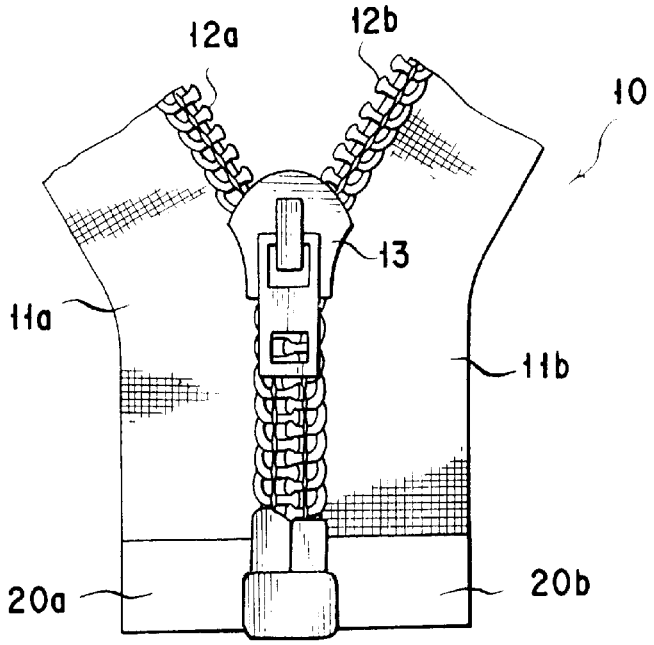
FIG. 3 is a fragmentary plan view showing the lower part of a slide fastener provided with reinforcing tapes of the present invention.
Figure 4:
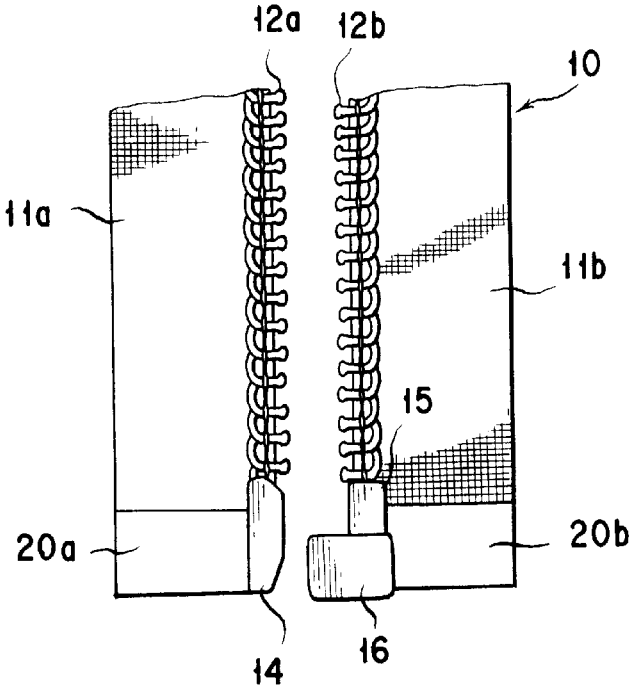
FIG. 4 is a fragmentary plan view showing the lower part of the slide fastener of FIG. 3 held in a separated state.

FIG. 3 and FIG. 4 each show the lower part of a slide fastener 10 having the reinforcing tapes 20*a* and 20*b* of the present invention provided at the lower end portions of a pair of fastener tapes 11*a* and 11*b* to which members of a pin-and-box separator are attached.

The slide fastener 10 shown in FIG. 3 includes a pair of fastener tapes 11*a* and 11*b*, a pair of reinforcing tapes 20*a* and 20*b* which are welded or fused to the lower end portions of the respective fastener tapes 11*a* and 11*b*, rows of coupling elements 12*a* and 12*b*, such as spiral coil coupling elements, attached to the inner longitudinal edges of the respective fastener tapes 11*a* and 11*b*, a slider 13, and a separable insertion joint or pin-and-box separator composed of an insertion member or butterfly bar 14, a box bar 15, and a box member 16, these members being secured to the inner edges of the reinforcing tapes 20*a* and 20*b* which are welded to the lower end portions of fastener tapes 11*a* and 11*b*. The slider 13 is slidably mounted on the rows of coupling elements 12*a* and 12*b* for engaging and disengaging the coupling elements 12*a* and 12*b*. FIG. 3 shows the slide fastener 10 in a closed state and FIG. 4 shows it in an opened state.

The fastener tapes 11*a* and 11*b* are manufactured by weaving or knitting a fibrous material formed of such synthetic fibers as polyester, nylon, etc. or such natural fibers as cotton. To the lower end portions of the pair of fastener tapes 11*a* and 11*b*, the reinforcing tapes 20*a* and 20*b* are respectively welded or fused through the medium of an adhesive layer as explained hereinbefore. The butterfly bar 14 which is one of the fitting metal pieces for the pin-and-box separator is secured to the inner edge of one, 20*a*, of the opposed reinforcing tapes and the box member 16 for admitting the butterfly bar 14 and the box bar 15 therefor are secured to the opposite inner edge of the other, 20*b*, of the reinforcing tapes. The butterfly bar 14 is releasably engageable in a slot in the box member 16. The box member 16 and the box bar 15 are integrally molded as one piece.

Figure 5:
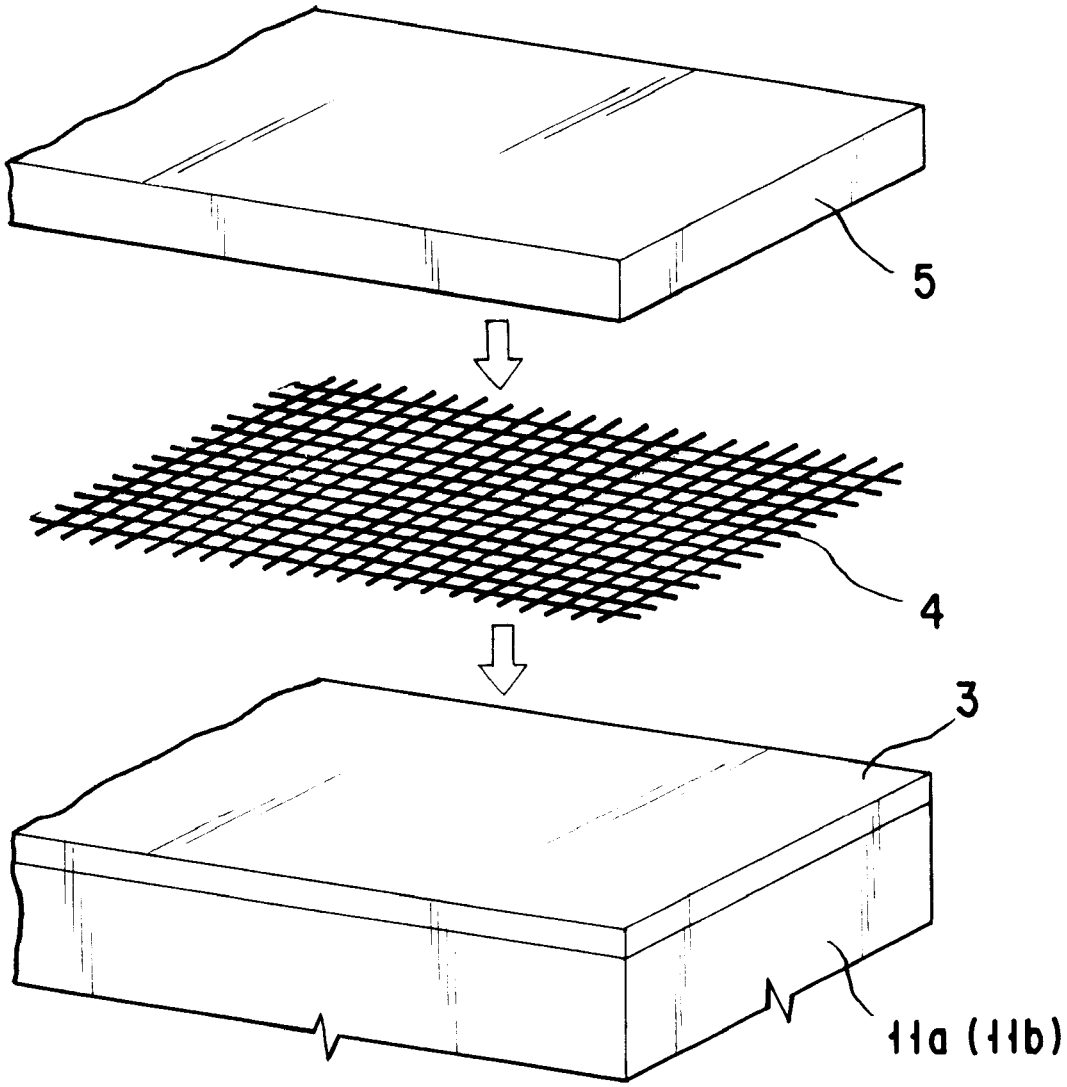
FIG. 5 is a schematic perspective view to aid in the description of one example of the procedure for securing a reinforcing tape to a fastener tape.

FIG. 5 illustrates one working example of the procedure for superposing the reinforcing tape 20*a* or 20*b* on the fastener tape 11*a* or 11*b*. In this example, the fixation of the reinforcing tape 20*a* or 20*b* to the fastener tape 11*a* or 11*b* was effected by first applying a copolymer polyester-based hot-melt adhesive as an adhesive layer 3 in a thickness of 60 μm to the prescribed end portion of a fastener tape 11*a* or 11*b*, 500 μm in thickness, manufactured from polyester fibers, then sequentially superposing thereon a reticular sheet formed of polyester monofilaments as a fiber reinforcement layer 4 (mesh of monofilaments, 50–120 μm in diameter, having a density in the range of 20–70/cm) and a polyester thermoplastic elastomer film, 120 μm in thickness, as a transparent film layer 5 in the order mentioned, and effecting fusion of the superposed layers by hotmelting. The end portion of the fastener tape to which the reinforcing tape had been powerfully joined by adhesion was found to possess proper flexibility, manifest high torsional strength and transverse tensile strength, appear in essentially the same color as the fastener tape, and enjoy a perfect appearance. When the fixation of the reinforcing tape to the end portion of the fastener tape was performed by repeating the procedure mentioned above while using a reticular sheet formed of polyamide monofilaments instead as a fiber reinforcement layer and a polyamide thermoplastic elastomer film or nylon film instead as a transparent film layer, the results were identical to those mentioned above.

When the reinforcing tape to be used is a laminate comprising a transparent film layer and a reticular sheet (or a thin layer non-woven fabric) laid therein parallel to the surface thereof or buried in the surface layer part thereof, it may be directly superposed on the adhesive layer 3 applied to the surface of the fastener tape 11*a* or 11*b* and joined fast thereto by application of heat and pressure. Naturally, the present invention can be embodied not only in the fastener tapes of the slide fastener but also in the fastener tapes of various types of slide fasteners.

The reinforcing tape of the present invention has a construction such that a transparent film layer formed of a thermoplastic elastomer or a thermoplastic resin is superposed on either or both of the opposite surfaces of a fiber reinforcement layer formed of a reticular sheet of thermoplastic resin monofilaments or a thin layer non-woven fabric of thermoplastic resin fibers of the same type as the transparent film layer as described above. It, therefore, possesses proper flexibility and, at the same time, excels in such mechanical strengths as torsional strength and transverse tensile strength. A slide fastener is enabled to acquire a reinforced part having the reinforcing tape of the construction described above joined thereto with thorough adhesive strength by setting this reinforcing tape in fast adhesion to the end portion of a fastener tape through the medium of an adhesive layer. Further, since the reinforcing tape of the present invention excels in flexibility, it can be easily shaped in perfect conformity with the contour of the core portion of the fastener tape. When it is repeatedly folded, the folded portion is not whitened. When it is fixed to the fastener tape, it allows the color of the fastener tape to be directly seen therethrough and will not impair the appearance of the fastener tape. The reinforcing tape of one kind, therefore, can fit fastener tapes of varying colors. Thus, this reinforcing tape does not need to be prepared in various kinds elaborately adapted to fit such varying colors. It finds no use for any complicated management of storage.

By reinforcing the end portion of the fastener tape with the reinforcing tape of the present invention, the produced slide fastener excels in adhesiveness enough to avoid sustaining separation, cracking, or wear due to the friction of the slider or the laundering and exciting no feeling of chromatic extraneity.

While certain specific embodiments have been disclosed herein, the invention may be embodied in other specific forms without departing from the spirit or essential characteristics thereof. The described embodiments are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

What is claimed is:

1. A reinforcing tape for attachment to a fastener tape of a slide fastener comprising (a) fiber reinforcement layer formed of either (a-1) a reticular sheet of thermoplastic resin monofilaments or (a-2) a thin-layer non-woven fabric of thermoplastic resin fibers and (b) at least one transparent film layer made of a thermoplastic elastomer or thermoplastic resin and adapted to be superposed on at least one surface of said fiber reinforcement layer, said fiber reinforcement layer (a) and said transparent film layer (b) being made of the same type of thermoplastic resin, said reticular sheet (a-1) being formed of thermoplastic resin monofilaments of a diameter in the range of 50 to 120 μm and having a density in the range of 20 to 70 monofilaments/cm in each of longitudinal and lateral directions, said thin-layer non-woven fabric having a thickness in the range of 50 to 120 μm.

2. The reinforcing tape according to claim 1, which further comprises an adhesive layer adapted to be adhered to the fastener tape in such a manner that said transparent film layer constitutes itself a surface layer.

3. The reinforcing tape according to claim 2, wherein said adhesive layer is formed of a hot-melt adhesive using as the raw material thereof a resin of the same type as the material of the fastener tape to which said adhesive layer is to be joined.

4. The reinforcing tape according to claim 2, which comprises the transparent film layer made of a thermoplastic elastomer or thermoplastic resin and having a thickness in the range of 50 to 150 μm, said fiber reinforcement layer being superposed on one surface of said transparent film layer, and the adhesive layer having a thickness in the range of 30 to 120 μm, said adhesive layer being superposed on said fiber reinforcement layer.

5. The reinforcing tape according to claim 4, which further comprises a transparent film layer made of a thermoplastic elastomer or thermoplastic resin and having a thickness in the range of 20 to 50 μm, said transparent film layer being interposed between said fiber reinforcement layer and said adhesive layer.

6. The reinforcing tape according to claim 1, wherein said fiber reinforcement layer is made of a polyester thermoplastic resin and said transparent film layer is made of a polyester thermoplastic elastomer.

7. The reinforcing tape according to claim 1, wherein said fiber reinforcement layer is made of a polyamide thermoplastic resin and said transparent film layer is made of a polyamide thermoplastic elastomer or nylon.

8. A slide fastener comprising a pair of fastener tapes each having an end portion reinforced with a reinforcing tape, said reinforcing tape comprising at least one transparent film layer made of a thermoplastic elastomer or thermoplastic resin and a fiber reinforcement layer formed of either a reticular sheet of monofilaments or a thin-layer non-woven fabric of fibers manufactured from a thermoplastic resin of the same type as the transparent film layer and being secured to the end portion of the fastener tape through the medium of an adhesive layer in such a manner that the transparent film layer constitutes itself a surface layer, said reticular sheet being formed of thermoplastic resin monofilaments of a diameter in the range of 50 to 120 $\mu$m and having a density in the range of 20 to 70 monofilaments/cm in each of longitudinal and lateral directions, said thin-layer non-woven fabric having a thickness in the range of 50 to 120 $\mu$m.

9. The slide fastener according to claim 8, which comprises two transparent films, one of which constituting a surface layer and the other being interposed between said fiber reinforcement layer and said adhesive layer.

10. The slide fastener according to claim 8, wherein said adhesive layer is formed of a hot-melt adhesive using as the raw material thereof a resin of the same type as the material of the fastener tape to which said adhesive layer- is to be joined.

11. The slide fastener according to claim 8, wherein said fiber reinforcement layer is made of a polyester thermoplastic resin and said transparent film layer is made of a polyester thermoplastic elastomer.

12. The slide fastener according to claim 8, wherein said fiber reinforcement layer is made of a polyamide thermoplastic resin and said transparent film layer is made of a polyamide thermoplastic elastomer or nylon.

13. A reinforcing tape for attachment to a fastener tape of a slide fastener comprising a fiber reinforcement layer formed of either a reticular sheet of thermoplastic resin monofilaments or a thin-layer non-woven fabric of thermoplastic resin fibers and at least one transparent film layer made of a thermoplastic elastomer or thermoplastic resin and adapted to be superposed on at least one surface of said fiber reinforcement layer, said fiber reinforcement layer and said transparent film layer being made of the same type of thermoplastic resin, said fiber reinforcement layer being superposed on one surface of said transparent film layer; and an adhesive layer superposed on said fiber reinforcement layer, said adhesive layer adapted to attach said reinforcing tape to the fastener tape of the slide fastener.

14. A reinforcing tape for attachment to a fastener tape of a slide fastener comprising a fiber reinforcement layer formed of either a reticular sheet of thermoplastic resin monofilaments or a thin-layer non-woven fabric of thermoplastic resin fibers and at least one transparent film layer made of a thermoplastic elastomer or thermoplastic resin and adapted to be superposed on at least one surface of said fiber reinforcement layer, said fiber reinforcement layer and said transparent film layer being made of the same type of thermoplastic resin, said fiber reinforcement layer being positioned within said transparent film layer and between opposite outer surfaces of said transparent film layer; and an adhesive layer being superposed on one side of said transparent film layer, said adhesive layer adapted to attach said reinforcing tape to the fastener tape of the slide fastener.

* * * * *